US011047649B2

(12) United States Patent
Geissele

(10) Patent No.: US 11,047,649 B2
(45) Date of Patent: Jun. 29, 2021

(54) FIREARM ACCESSORY MOUNT

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 141 days.

(21) Appl. No.: 16/659,948

(22) Filed: Oct. 22, 2019

(65) Prior Publication Data

US 2020/0049459 A1 Feb. 13, 2020

Related U.S. Application Data

(60) Division of application No. 16/224,919, filed on Dec. 19, 2018, now Pat. No. 10,663,262, which is a continuation of application No. 14/996,720, filed on Jan. 15, 2016, now abandoned.

(51) Int. Cl.

| | |
|---|---|
| ***F41G 11/00*** | (2006.01) |
| ***F41G 1/387*** | (2006.01) |
| ***F41G 1/393*** | (2006.01) |

(52) U.S. Cl.

CPC ..... *F41G 11/003* (2013.01); *F41G 1/387* (2013.01); *F41G 1/393* (2013.01); *F41G 11/004* (2013.01)

(58) Field of Classification Search

CPC ..... F41G 11/003; F41G 1/387; F41G 11/004
USPC ..... 42/124
See application file for complete search history.

(56) References Cited

U.S. PATENT DOCUMENTS

| | | | | |
|---|---|---|---|---|
| 3,299,558 | A | 1/1967 | Anthony | |
| 4,531,321 | A * | 7/1985 | Bechtel | F41G 11/003 42/126 |
| 4,574,508 | A | 3/1986 | Ross | |
| D383,826 | S * | 9/1997 | Weigand | D22/109 |
| 5,813,131 | A | 9/1998 | Werre | |
| 5,926,964 | A * | 7/1999 | Korapaty | F41G 11/003 42/124 |
| 5,941,006 | A * | 8/1999 | Horton | F41G 11/003 42/124 |
| 6,199,271 | B1 | 3/2001 | Hahn et al. | |
| D632,753 | S * | 2/2011 | Leighton | D22/109 |
| 8,205,375 | B1 * | 6/2012 | Swan | F41G 11/003 42/124 |
| 8,333,029 | B1 | 12/2012 | Noveske | |
| 8,365,647 | B2 | 2/2013 | Lippard | |

(Continued)

OTHER PUBLICATIONS

Calguns.net, RogueSniper, my scope rings are scratching my scope!, http://www.calguns.net/calgunforum/archive/index.php/t-154384.html, Feb. 15, 2009, pp. 1-2 (Year: 2009).*

(Continued)

*Primary Examiner* — Joshua E Freeman
(74) *Attorney, Agent, or Firm* — Fox Rothschild LLP

(57) ABSTRACT

A firearm accessory mount is described herein. The firearm accessory mount is manufactured by securing a raw amount of material, shaping the raw amount of material to generate receiving structures positioned on a mounting base along a common axis, forming apertures through the receiving structures to form accessory rings along a single axis from one direction and at least substantially dividing each of the accessory rings into receivers and caps.

13 Claims, 14 Drawing Sheets

(56) References Cited

U.S. PATENT DOCUMENTS

| | | | | |
|---|---|---|---|---|
| D715,393 | S * | 10/2014 | Williams | D22/109 |
| D732,631 | S | 6/2015 | Cheng et al. | |
| D753,784 | S | 4/2016 | Montes | |
| D755,342 | S * | 5/2016 | Ding | D22/109 |
| 9,759,527 | B2 | 9/2017 | Davis | |
| 2003/0154641 | A1* | 8/2003 | Stover | F41G 11/003 42/124 |
| 2007/0033852 | A1* | 2/2007 | Adams | F41G 11/001 42/124 |
| 2007/0266611 | A1* | 11/2007 | Stover | F41G 11/003 42/124 |
| 2008/0092422 | A1 | 4/2008 | Daniel et al. | |
| 2008/0178511 | A1 | 7/2008 | Storch et al. | |
| 2009/0101776 | A1 | 4/2009 | Peterson et al. | |
| 2009/0133311 | A1* | 5/2009 | Hollenbach | F41G 11/001 42/124 |
| 2009/0278399 | A1 | 11/2009 | Srivats et al. | |
| 2011/0099877 | A1 | 5/2011 | Sandler | |
| 2013/0008073 | A1 | 1/2013 | Clifton et al. | |
| 2013/0312309 | A1* | 11/2013 | Rorick | F41C 27/00 42/114 |
| 2014/0096429 | A1 | 4/2014 | Sandler et al. | |
| 2014/0190062 | A1* | 7/2014 | Turner, Jr. | F41G 11/003 42/124 |
| 2014/0224575 | A1 | 8/2014 | Latka | |
| 2014/0259854 | A1* | 9/2014 | Williams | F41G 11/003 42/124 |
| 2016/0209176 | A1* | 7/2016 | Zimmer | F41G 11/001 |
| 2016/0341522 | A1* | 11/2016 | Davis | F41G 11/003 |

OTHER PUBLICATIONS

Thirdeyetacticle, scope ring manufacture, Nov. 26, 2009, Youtube video; https://www.youtube.com/watch?v=9Rscui45sGA, 0:00-3:43 (Year: 2009).*

* cited by examiner

FIREARM ACCESSORY MOUNT

CROSS-REFERENCE TO RELATED APPLICATIONS

This application is a divisional of U.S. patent application Ser. No. 16/224,919 filed Dec. 19, 2018, which is a continuation of U.S. patent application Ser. No. 14/996,720 filed Jan. 15, 2016, the disclosures of which are hereby incorporated by reference in their entireties.

BACKGROUND

Accessories, such as scopes, are often mounted on firearms to aid the operator in accurately aiming the firearm. A common type of scope is a telescopic sight which includes optical components that magnify the target, and also typically include a visual element such as a reticle that identifies a specific location at which the firearm is currently aimed. Firearm scopes can be secured to the firearm using a scope mount. More specifically, at least some scope mounts are secured to a firearm by fastening to a mounting rail located at or adjacent to an upper receiver of the firearm.

SUMMARY

This disclosure generally relates to a firearm scope mount. Various aspects of the firearm scope mount are described in this disclosure, which include, but are not limited to, the following aspects.

One aspect is a method of manufacturing a firearm accessory mount, the method comprising: securing a raw amount of material; shaping the raw amount of material to generate accessory rings positioned on a mounting base along a common axis; forming apertures through the accessory rings along a single axis; and at least substantially dividing each of the accessory rings into receivers and caps.

Another aspect is a firearm accessory mount comprising: a mounting base comprising a proximal end and a distal end, the mounting base comprising a firearm fastener; a proximal receiver extending from the mounting base proximal end; a proximal cap substantially divided from the proximal receiver, the proximal receiver and the proximal cap being connected by a manually separable sliver of material, the proximal cap and the proximal receiver defining an internal passageway oriented about a first longitudinal axis; a distal receiver extending from the mounting base distal end; and a distal cap substantially divided from the distal receiver, the distal receiver and the distal cap being connected by a manually separable sliver of material, the distal cap and the distal receiver defining an internal passageway oriented about the first longitudinal axis, the distal internal passageway being concentrically aligned with the proximal internal passageway.

Yet another aspect is a method of ensuring alignment of proximal and distal receiving structures, the method comprising: shaping the proximal and distal receiving structures while both are rigidly secured with respect to each; forming apertures within the proximal and distal receiving structures along a single axis from a single direction; and creating dividing channels through the proximal and distal receiving structures, the proximal dividing channel and the distal dividing channel being co-planar.

DESCRIPTION

Figure 1:
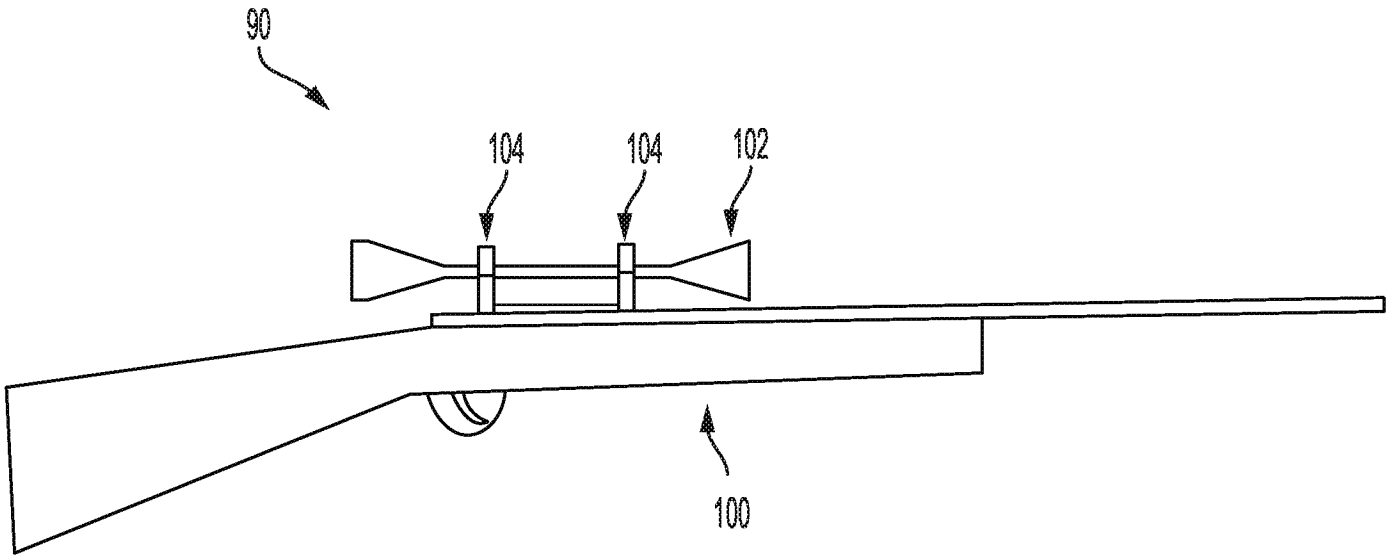
FIG. 1 shows a side view of a firearm according to an example embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a side view of an example firearm system 90. In this example, the firearm system 90 includes a firearm 100, a scope 102 and an accessory mount 104. The illustrated scope 102 is secured to the firearm 100 with the accessory mount 104. The illustrated firearm 100 can be any firearm that fires projectiles, such as bullets or shot, and can support a scope with a mount. For example, the illustrated firearm 100 can be a rifle, a shotgun or a pistol. The illustrated firearm 100 is defined by an upper receiver and a lower receiver, and includes a barrel, a trigger and a stock.

The illustrated scope 102 can be any scope that functions to enhance the accuracy of a user's aim while using the firearm 100. The illustrated scope 102 can have a central narrow mounting section extending between front and rear expanded magnification sections containing lenses.

The illustrated accessory mount 104 functions to secure the scope 102 to the firearm 100. The accessory mount 104 can be secured to the upper receiver of the firearm 100, for example to a mounting rail. The illustrated accessory mount 104 can have a pair of rings, front and rear, that support the scope 102. The rings of the illustrated accessory mount 104 receive the narrow section of the scope 102. The illustrated accessory mount 104 can alternatively support a variety of different accessories used with firearms, for example cylindrical accessories such as laser sights.

Another example firearm system 90 includes the firearm 100 and the mount 104, but does not include the scope 102. In this example, the firearm system 90 is configured to receive a scope 102, or other accessories, but the scope is not included.

Figure 2:
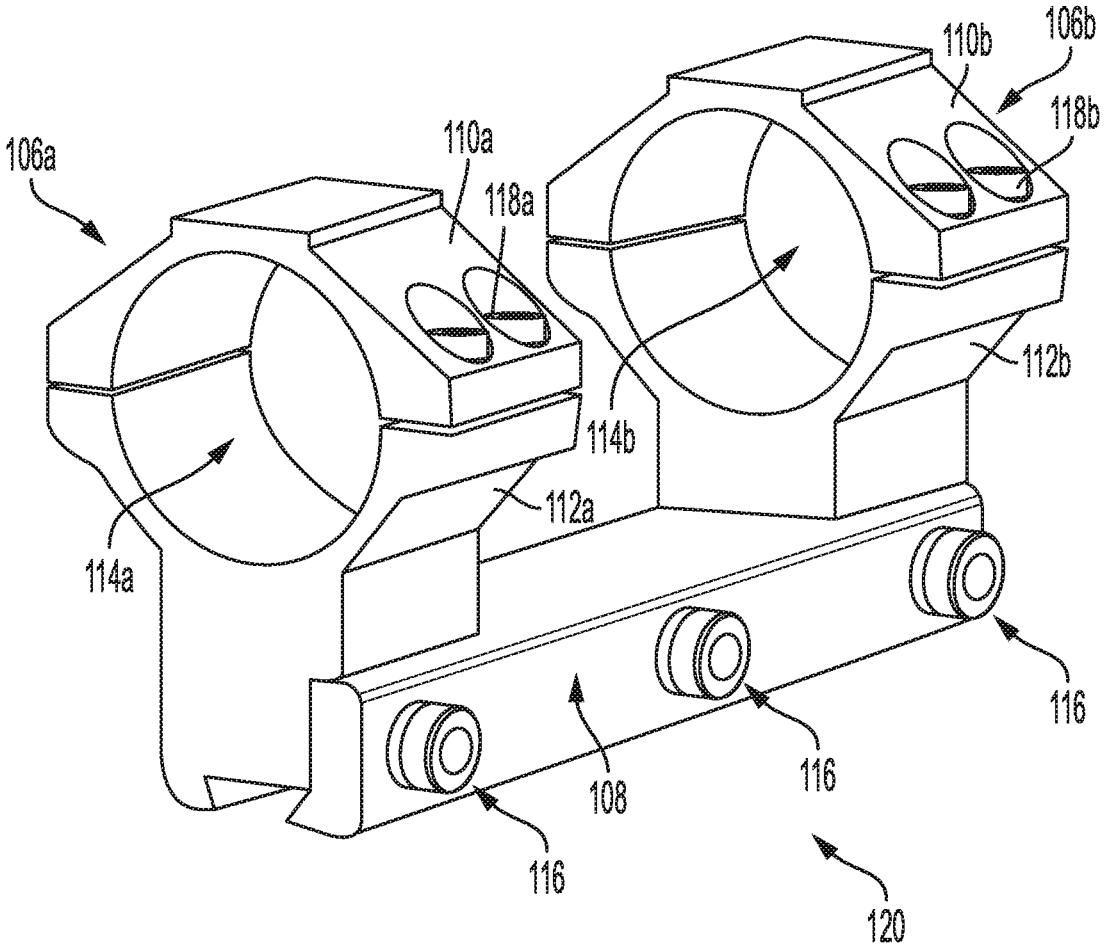
FIG. 2 shows a perspective view of a scope mount according to another example embodiment of the present disclosure.

FIG. 2 is a perspective view of a mount 120 which can function similarly to the mount 104 illustrated in FIG. 1. The illustrated mount 120 can have a mounting base 108, a rear mounting ring 106*a* and a front mounting ring 106*b*.

The illustrated mounting base 108 has a front end and a rear end. The illustrated mounting base 108 can have a fastener 116, or plurality of fasteners, that receives and secures to a firearm. The fastener of the illustrated mounting base 108 can secure to an upper receiver of a firearm, for example through a mounting rail mounted to the firearm.

The illustrated rear mounting ring 106*a* is secured to and extends upwardly from the rear end of the mounting base 108. The illustrated front mounting ring 106*b* is secured to and extends upwardly from the front end of the mounting base 108.

The illustrated rear mounting ring 106*a* can have an internal passageway 114*a* defined by a lower receiver 112*a* and an upper cap 110*a*. The lower receiver 112*a* and the upper cap 110*a* are separable from each other and can be secured to each other with a fastener 118*a* or plurality of fasteners, for example a tightening screw and nut, or clip. The illustrated internal passageway 114*a* can have a shape resembling a circle to snugly engage an accessory, such as a scope, that is secured therein. The illustrated lower receiver 112*a* can define a lower section of the internal passageway 114*a* and the upper cap 110*a* can define the upper section of the internal passageway. In use, the upper cap 110*a* is disengaged from the lower receiver 112*a* so that a section of an accessory can be set within the lower section of the internal passageway 114*a* within the lower receiver. The upper section of the internal passageway 114*a*, as defined by the upper cap 110*a*, is then set around the accessory, so that the upper cap engages the lower receiver 112*a* on either side of the accessory. A fastener 118*a*, or fasteners, is then tightened between the upper cap 110*a* and the lower receiver 112*a* to ensure that the accessory is secured within the internal passageway 114*a*.

The illustrated front mounting ring 106*b* can be geometrically and functionally similar to the rear mounting ring 106*a* described above. The rear mounting ring 106*a* and the front mounting ring 106*b* function together to receive and support the scope described with respect to the rear mounting ring.

The illustrated front mounting ring 106*b* can have an internal passageway 114*b* defined by a lower receiver 112*b* and an upper cap 110*b*. The lower receiver 112*b* and the upper cap 110*b* are separable from each other and can be secured to each other with a fastener 118*b* or fasteners, for example a tightener screw and nut, or clip. The illustrated internal passageway 114*b* can have a shape resembling a circle to snugly engage an accessory, such as a scope, that is secured therein. The illustrated lower receiver 112*b* can define a lower section of the internal passageway 114*b* and the upper cap 110*b* can define the upper section of the internal passageway. In use, the upper cap 110*b* is disengaged from the lower receiver 112*b* so a section of the accessory can be set within the lower section of the internal passageway 114*b* within the lower receiver. The upper section of the internal passageway 114*b*, as defined by the upper cap 110*b*, is then set around the accessory, so that the upper cap engages the lower receiver 112*b*. A fastener 118*b* or fasteners is then tightened between the upper cap 110*b* and the lower receiver 112*b* to ensure that the accessory is secured within the internal passageway 114*b*.

In order to maintain accuracy of aiming an accessory, such as a scope or laser sight, that would be mounted to a firearm by the illustrated mount 120, it is important that the rear internal passageway 114*a* and the front internal passageway 114*b* are concentrically aligned and oriented with respect to a common axis. Such concentric orientation and alignment reduces any errors between the direction of an accessory and the direction of a firearm.

A raw piece of aluminum can have internal stresses which are imparted when an extrusion is created. By machining a large amount of material, such as the gap between two scope rings for use on a firearm, small springing or distortions can occur. Example methods for manufacturing firearm accessory mounts can cause inaccuracies when using the mount on a precision weapon. An example inaccuracy includes how the accessory clamps interact with bases. In one example, the accessory clamps (the small pieces which retain the accessory from the top) are machined separately from the cradle. By doing so the surfaces which clamp and secure the accessory are not concentric to each other, causing uneven clamping force on the accessory, for example the scope tube. Additionally, another error occurs in that the bore of one accessory ring is not concentric to the bore of the other ring on the same mount. Accordingly, additional improvements are desired which reduce the stresses during manufacturing to ensure a high level of accuracy during operation.

Figure 3:
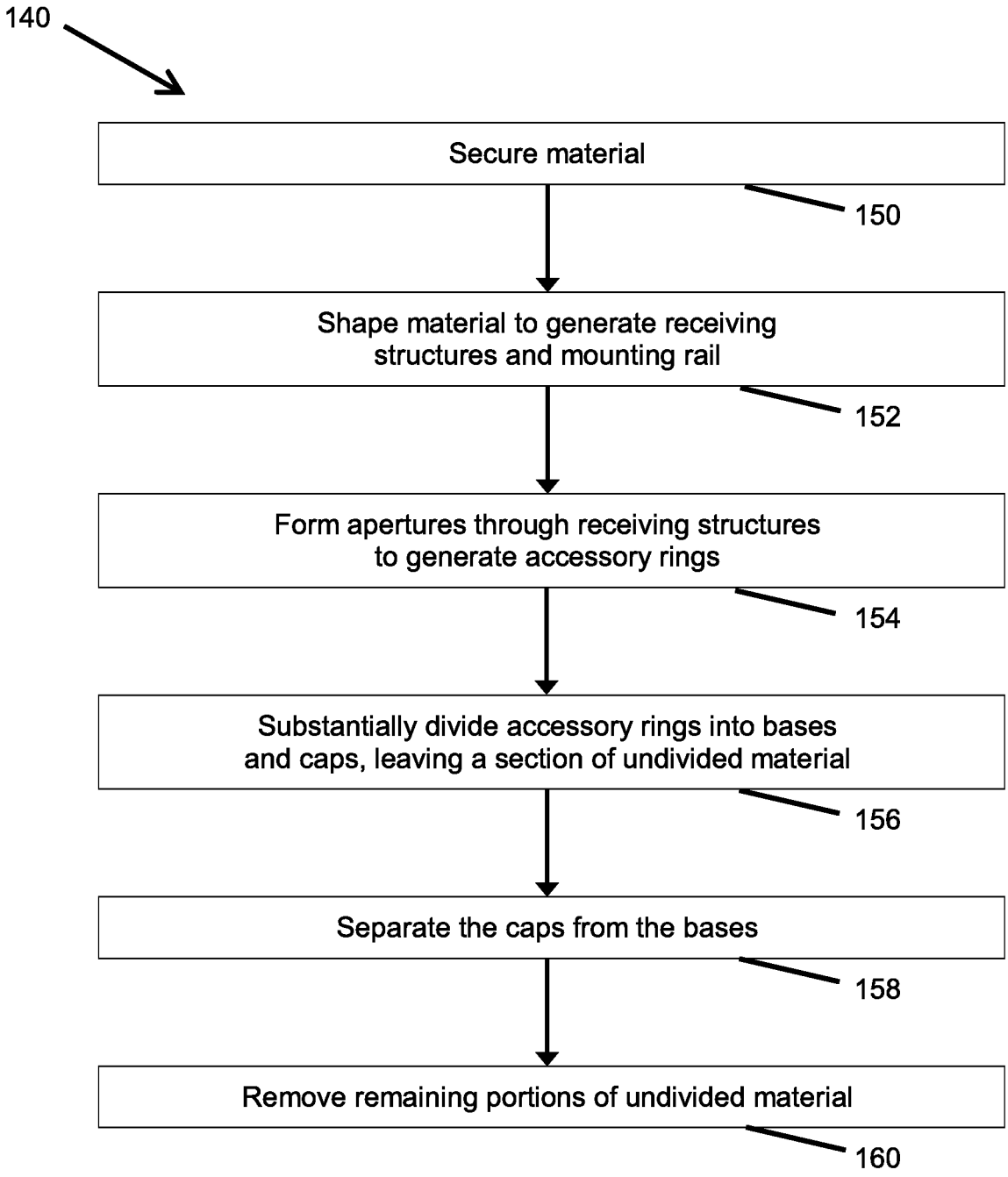
FIG. 3 shows a flowchart of a method for making a scope mount according to another example embodiment of the present disclosure.\

FIG. 3 illustrates an example method 140 for making a firearm accessory mount. In this example, the method includes operations 150, 152, 154, 156, 158, and 160. In some embodiments the operations 150, 152, 154, and 156 are performed by a manufacturer, while the operations 158 and 160 are performed by another, such as by an installer or an end user, for example. In another embodiment, the method 140 may be entirely performed by the manufacturer. In yet other embodiments, the operations may be divided among several people or companies.

In this example the method 140 begins with an operation 150 in which a material is secured. In some embodiments the material can be rigid and durable, yet able to be extruded and cut into, for example plastic or metal. More specifically, the example material can be aluminum or steel. The material can be secured 150 with a machining clamp, for example a fixing device with a pair of opposing jaws that tighten toward each other, or a vice. In another possible embodiment, the material is held in an alternative manner that achieves positional stability, such as during the subsequent forming operation 154. Securing 150 the material allows a user to maintain an exact orientation or the material during the remaining steps of the method 140. An example of operation 150 is illustrated and described in further detail with reference to FIGS. 4 and 5.

The operation 152 is performed to shape the material. In some embodiments the shaping includes generating accessory rings and a mounting rail. In an example illustrated in further detail herein, two accessory rings are formed that are aligned along a common axis. The accessory rings are left connected at bottom ends to a mounting rail that extends between the two accessory rings. The shaping operation 152 is performed with the material secured in the securing operation 150. The shaping operation 152 can be performed with a shaper that forms and shapes the metal from the raw extrusion form into a predetermined geometry. An example shaper can be a lathe and a CNC machine. The shaping operation 152 transforms the raw extrusion of material into the general geometry of an accessory mount. An example of the shaping operation 152 is illustrated and described in further detail with reference to FIGS. 6 and 7.

The operation 154 is performed to form apertures through the receiving structures to form the accessory rings. In some embodiments the aperture is formed along a single axis and from one direction. In some embodiments the accessory rings are concentric with each other along the single axis. The forming operation 154 can be completed with a forming tool that forms apertures in the receiving structures to form the accessory rings. An example forming tool can be a lathe, a boring machine or a drill bit. The forming operation 154 is performed with the material secured in the securing operation 150. An example of the operation 154 is illustrated and described in further detail with reference to FIGS. 8 and 9.

The forming operation 154 is completed after the shaping operation 152 in at least some embodiments to reduce springing or distortion between the accessory rings. If the apertures were formed before the shaping process, springing or distortion can result in misalignment of the aperture from one accessory ring to the other.

The operation 156 is performed to substantially divide the formed accessory rings into bases and caps. The dividing operation 156 can be performed with a dividing tool which divides metal, for example a saw or a laser. The dividing tool can divide the pair of accessory rings along a common plane so that the bases are identical and the caps are identical. The caps are retained onto the bases with a thin sliver section of undivided material that is not divided by the dividing tool. The dividing operation 156 is performed with the material secured in the securing operation 150. The dividing operation 156 is completed after the forming operation 154 to ensure alignment and consistency of geometry between the accessory rings. By completing the forming operation 154 of the accessory rings with the bases and caps still connected, the aperture concentricity is maintained allowing for a tighter fit to the accessory. Also, any stresses or movement which occurs during the shaping operation 152 of the material does not adversely affect the final product, such as misalignment of the caps and the bases.

The operation 158 is performed to snap the caps apart from the bases. The snapping operation 158 can be completed by breaking the section of undivided material between the bases and caps. A user can perform the snapping operation 158 manually by hand. The snapping operation 158 can be performed separately from operations 150, 152, 154 and 156, for example by an end user to which the shaped, formed and divided scope mount has been removed from the securing device and delivered.

The operation 160 is performed to buff or sand the snapped-apart bases and caps to remove any residue of the undivided material. The buffing operation 160 can be performed with a buffing tool, for example with a buffing wheel or sanding wheel. The buffing operation 160 is performed after the snapping operation 158. The buffing operation 160 can be performed separately from operations 150, 152, 154 and 156, for example by an end user to which the shaped, formed and divided accessory mount has been removed from the securing device and delivered.

Figure 4:
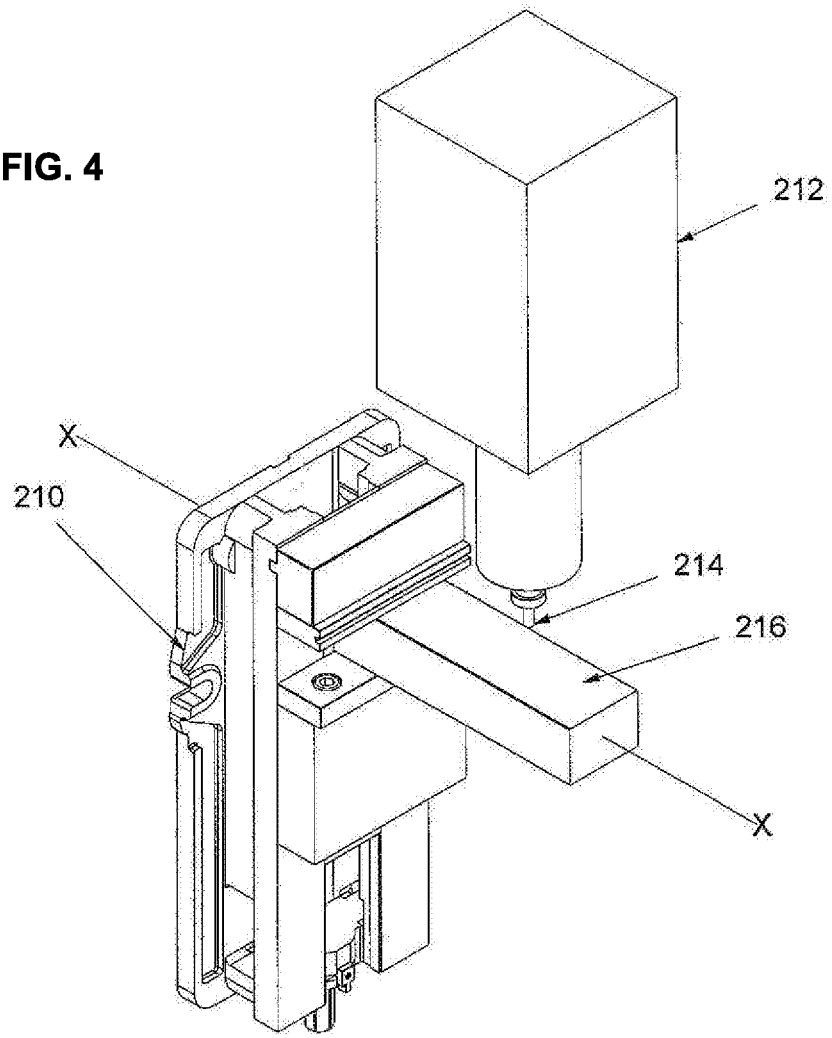
FIG. 4 shows a right side perspective view of a raw extrusion of material secured in a clamp and ready for machining by a machining tool.

FIG. 4 illustrates an example of the securing operation 150 described in FIG. 3. FIG. 4 illustrates a securing device 210, a machine 212, a shaping tool 214 and a raw extrusion of material 216. As illustrated, a raw extrusion of material 216 secured in a securing device 210, for example a clamp. The illustrated raw extrusion of material 216 can have an elongated block-like geometry that extends along an axis X. A machine 212 that powers alternative interchangeable tools, such as drill bits, is illustrated to secure and operate a shaping tool 214 for shaping the raw extrusion of material 216. An example shaping tool 214 can be a machining bit operable within the machine 212.

Figure 5:
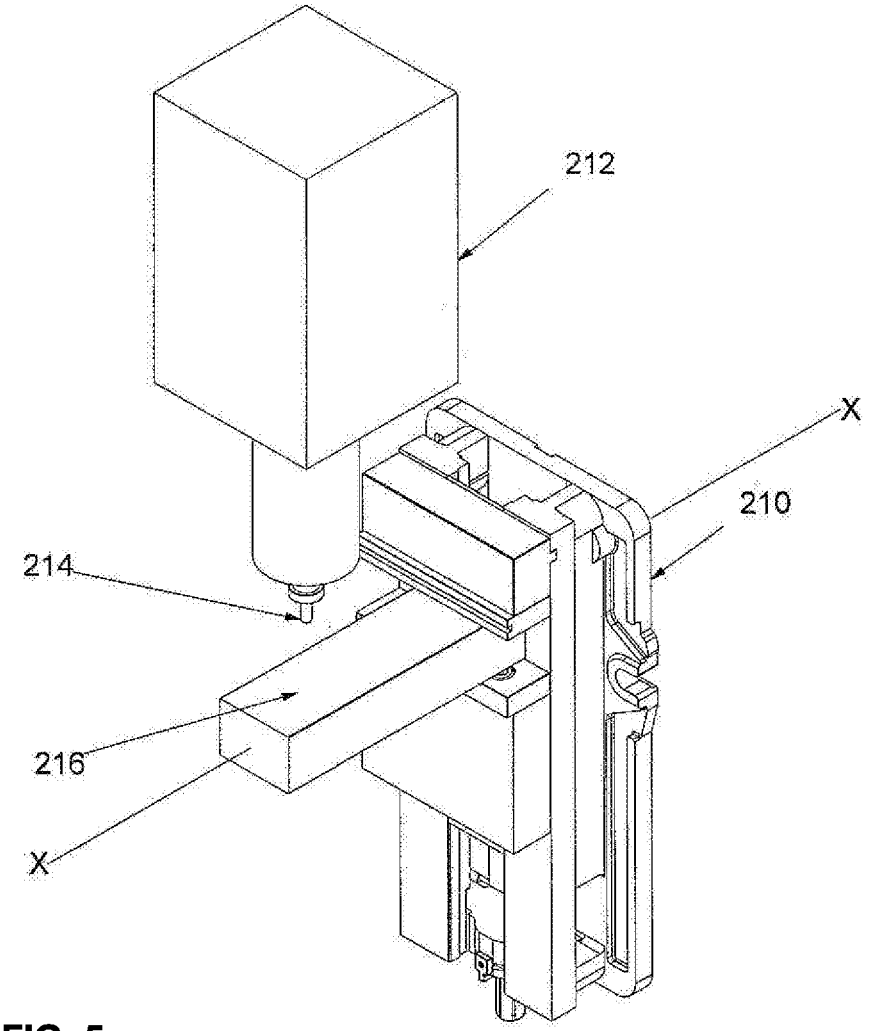
FIG. 5 shows a left side perspective view of the raw extrusion of material secured in the clamp and ready for machining by the machining tool, shown in FIG. 4.

FIG. 5 illustrates an example of the securing operation 150 described in FIG. 3, and illustrated in FIG. 4, as viewed along a different orientation. FIG. 5 illustrates a securing device 210, a machine 212, a shaping tool 214 and a raw extrusion of material 216. As illustrated, the raw extrusion of material 216 is secured in the securing device 210 so that the machine 212 can use the shaping tool 214 to shape the raw extrusion of material into a different geometry.

Figure 6:
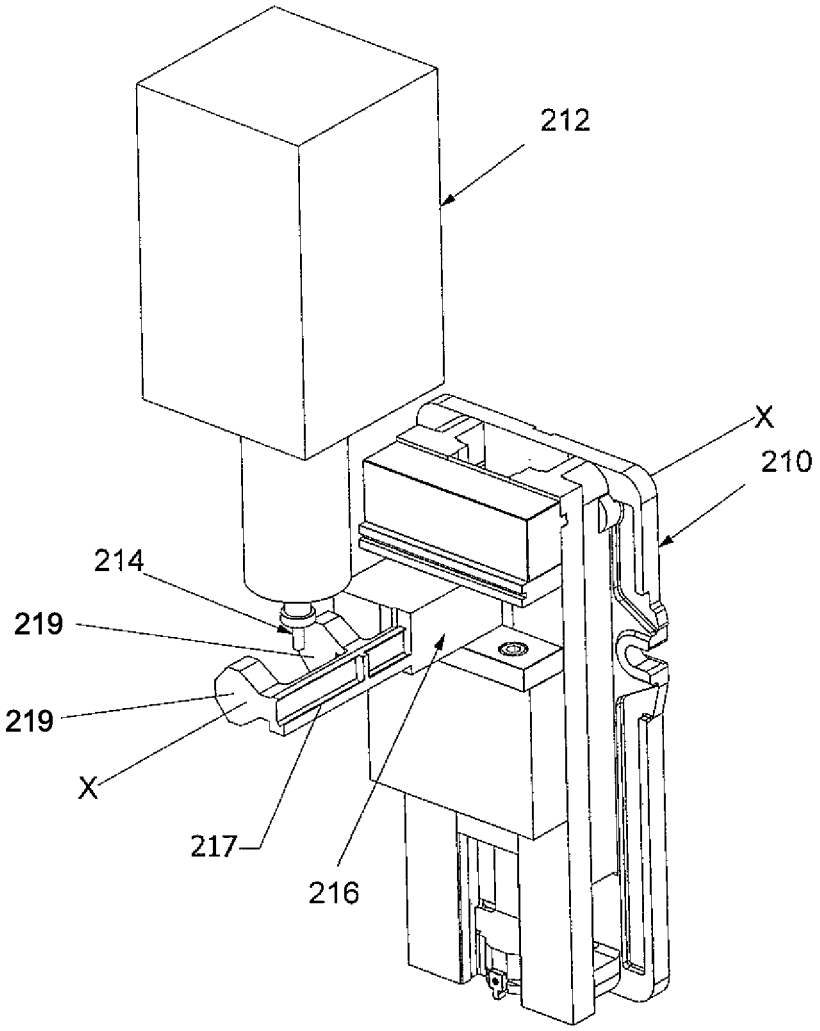
FIG. 6 shows a left side perspective view of a partially machined raw extrusion of material shown in FIG. 4 secured in the clamp.

FIG. 6 illustrates an example of the shaping operation 152 described in FIG. 3. FIG. 6 illustrates a securing device 210, a machine 212, a shaping tool 214, a raw extrusion of material 216, a mounting base 217 and a pair of receiving structures 219. The raw extrusion of material 216 remains secured in the securing device 210. The shaping tool 214 powered by the machine 212 is shown to have shaped a section of the raw extrusion of material 216 into a pair of receiving structures 219 separated along, and supported by a mounting base 217. The pair of receiving structures 219 and mounting base 217 can have geometries resembling the pair of accessory rings and mounting base illustrated in FIG. 2. As depicted, the pair of receiving structures 219 are aligned concentrically along the axis X. An unshaped portion of the raw extrusion of material 216 is not removed from the securing device 210 during shaping by the shaping tool 214. The shaping tool 214 shapes the raw extrusion of material 216 into the pair of receiving structures 219 and mounting base 217 from a variety of angles with respect to the axis X.

Figure 7:
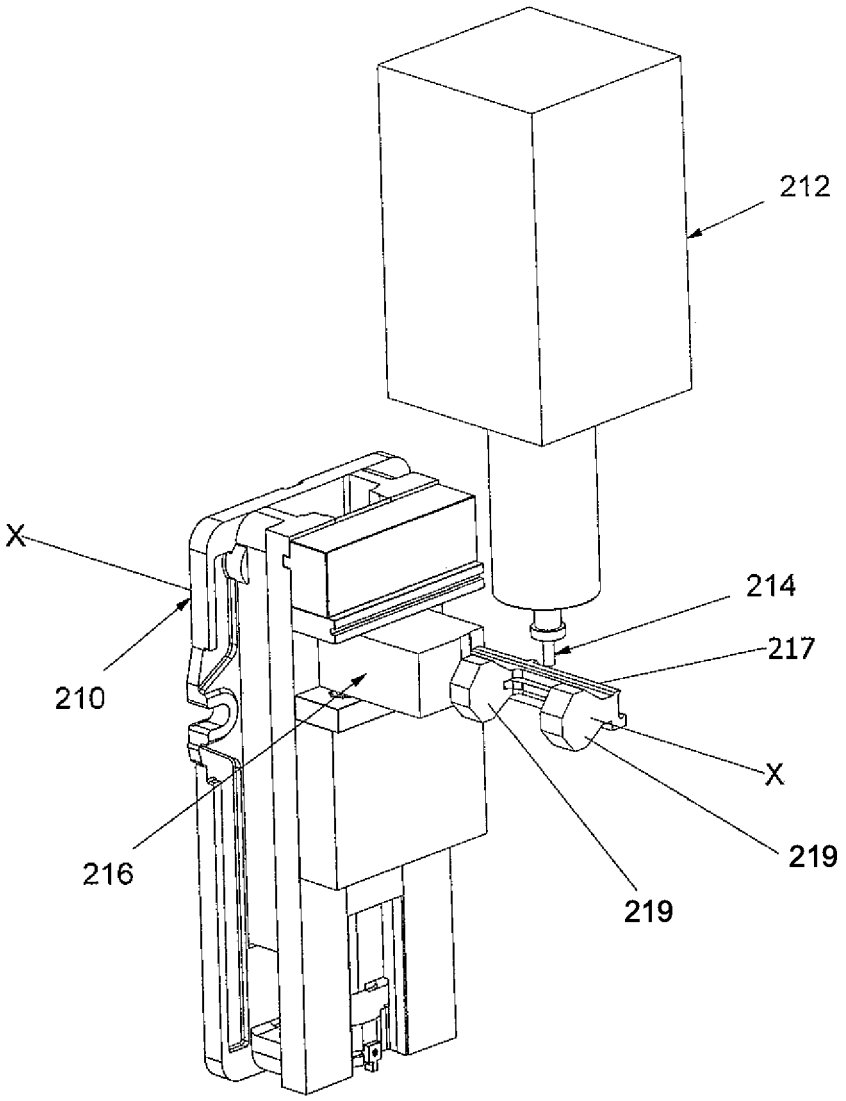
FIG. 7 shows a right side perspective view of the partially machined raw extrusion of material shown in FIG. 6 secured in the clamp.

FIG. 7 illustrates an example of the shaping operation 152 described in FIG. 3, and illustrated in FIG. 6, as viewed along a different orientation. FIG. 7 illustrates a securing device 210, a machine 212, a shaping tool 214, a raw extrusion of material 216, a mounting base 217 and a pair of receiving structures 219. As illustrated, the unshaped portion of the raw extrusion of material 216 is secured in the securing device 210 so that the machine 212 can use the shaping tool 214 to form the raw extrusion of material into a different geometry that includes the pair of receiving structures 219 and the mounting base 217.

Figure 8:
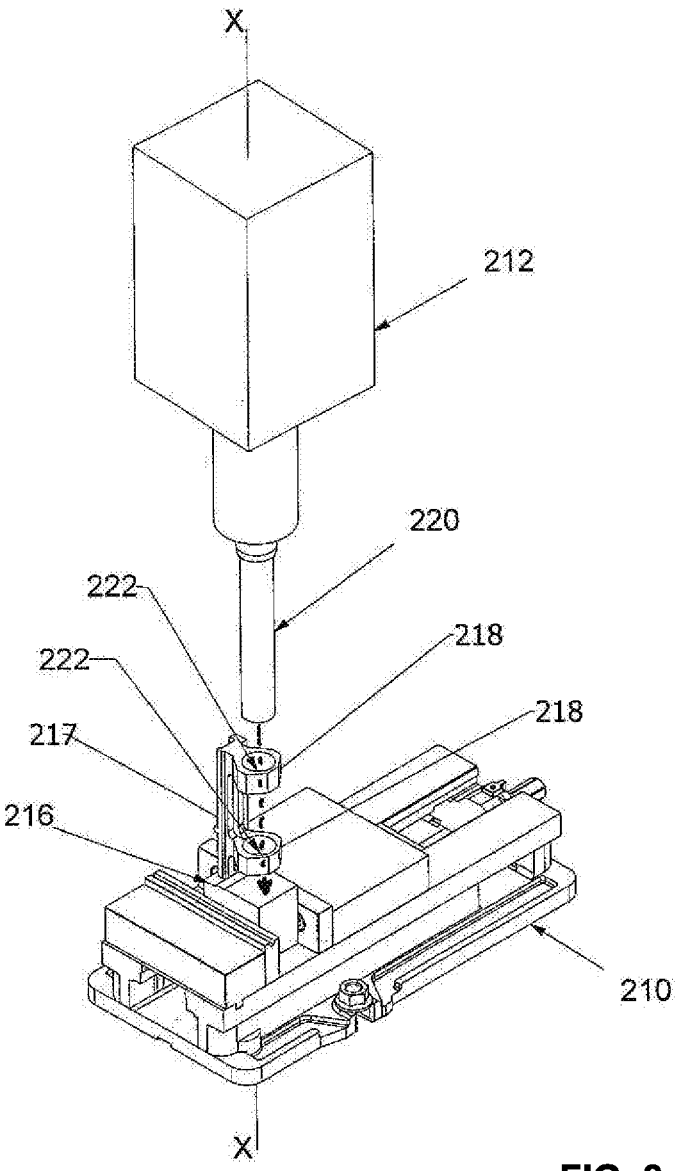
FIG. 8 shows a right side perspective view of partially machined raw extrusion of material shown in FIG. 6 secured in the clamp and having been bored with a boring tool.

FIG. 8 illustrates an example of the forming operation 154 described in FIG. 3. FIG. 8 illustrates a securing device 210, a machine 212, a forming tool 220, a raw extrusion of material 216, a mounting base 217, a pair of accessory rings 218 and apertures 222 therein. The portion of unshaped raw extrusion of material 216, illustrated in FIGS. 6 and 7, is secured in the securing device 210 along the axis X. The shaped accessory rings 218 are supported along the mounting base 217. A forming tool 220 is secured to the machine 212 after the shaping tool 214 was removed. The forming tool 220 forms apertures 222 within the receiving structures to form accessory rings 218. An example forming tool 220 can be a boring bit operable within the machine 212. As illustrated, the formed apertures 222 can be concentric with each other along the axis X. The illustrated accessory rings, 218 and apertures 222 can have geometries resembling the accessory rings and apertures described in the example illustrated in FIG. 3. The forming tool 220 forms the apertures 222 along the axis X from a single direction, for example from the distal ring 218 toward the proximal ring, as the distal ring is distal from the unshaped portion of the raw extrusion of material 216.

Figure 9:
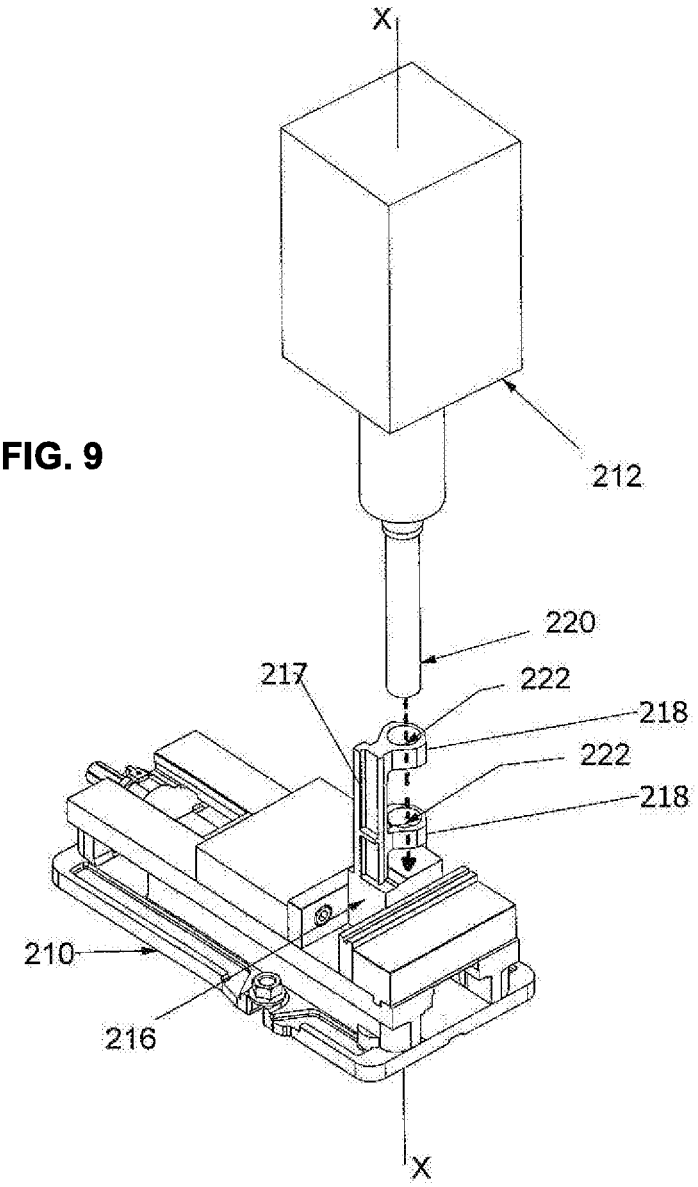
FIG. 9 shows a left side perspective view of partially machined raw extrusion of material shown in FIG. 8 secured in the clamp and having been bored with the boring tool.

FIG. 9 illustrates an example of the forming operation 154 described in FIG. 3, and illustrated in FIG. 8, as viewed along a different orientation. FIG. 9 illustrates a securing device 210, a machine 212, a forming tool 220, a raw extrusion of material 216, a mounting base 217, a pair of accessory rings 218 and apertures 222 therein. As illustrated, the unshaped portion of the raw extrusion of material 216 is secured in the securing device 210 so that the machine 212 can use the forming tool 220 to form the apertures 222 through the receiving structures to form the pair of accessory rings 218 secured to the mounting base 217.

The forming operation 154 can cause springing (or elastic springback) or distortion of the material 216 due to the friction caused by the mechanical motion of the forming tool 220. If the forming operation 154 is performed before the shaping operation 152, such springing or distortion of the material 216 can cause over-stress of the material and thus misalignment of the apertures from one accessory ring to the other. However, by performing the forming operation 154 after the shaping operation 152, such springing or distortion of the material 216 is reduced due to the reduced material in the accessory rings 218, and alignment and concentricity of the accessory rings is greatly improved. Performing the shaping operation 152 before the forming operation 154 allows the accessory rings 218 to return to a natural free state without stresses which would otherwise move the accessory rings when being formed.

Figure 10:
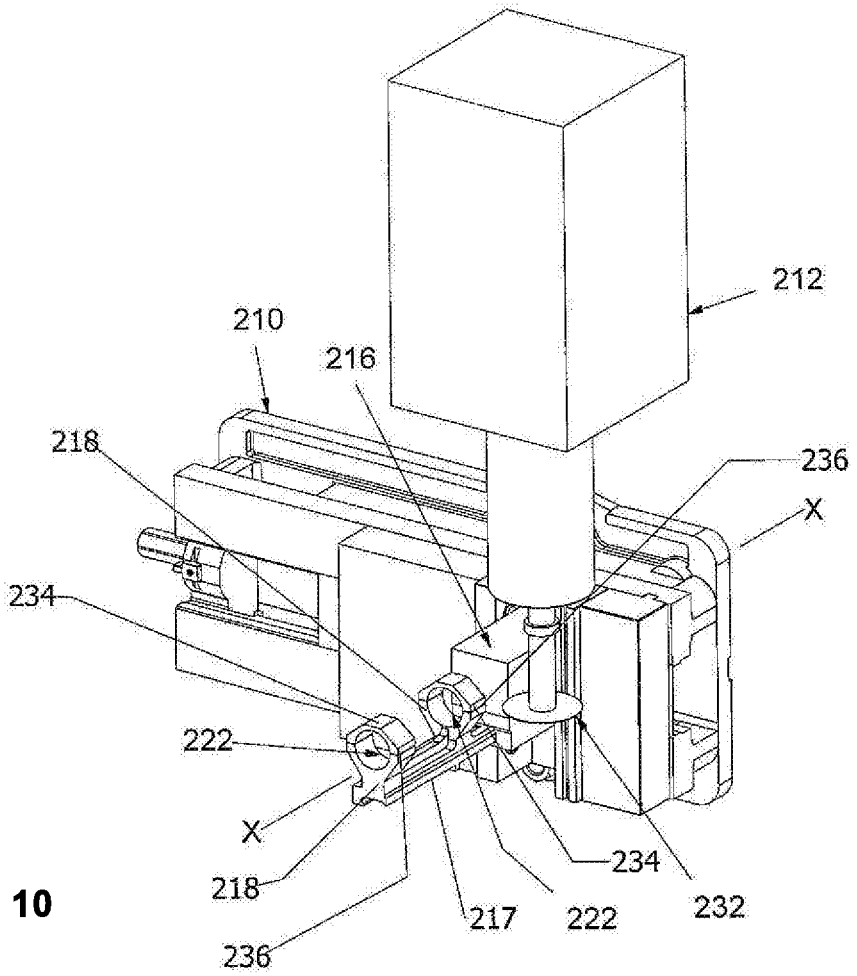
FIG. 10 shows a right side perspective view of the bored and partially machined raw extrusion of material shown in FIG. 9 having been cut with a cutting tool.

FIG. 10 illustrates an example of the dividing operation 156 described in FIG. 3. FIG. 10 illustrates the securing device 210, the machine 212, the unshaped portion of the raw extrusion of material 216, the mounting base 217, the accessory rings 218 and formed apertures 222 defining internal passageways, a dividing tool 232, an upper cap 234 and a dividing channel 236. A dividing tool 230 can be secured to the machine 212 after the forming tool 220 (shown in FIG. 9) is removed. The dividing tool 230 generates a dividing channel 236 into the accessory rings 218. An example dividing tool 232 can be a cutting saw, for example with a 0.016 in thickness, operable within the machine 212. The dividing channel 236 substantially (i.e., nearly entirely) divides each accessory ring 218 into a lower receiver extending from the mounting base 217 and an upper cap 234. The dividing channel 236 extends substantially through each accessory ring 218, leaving a sliver of material undivided (or uncut) to maintain the connection between the lower receivers and the upper caps 234. This sliver of uncut material is further described in FIGS. 12 and 13 below. The illustrated accessory rings, 218, lower receivers and upper caps 234 can have geometries resembling the accessory rings, lower receivers and upper caps described in the example illustrated in FIG. 3. In an example, the lower receiver of the accessory rings 218 and the upper caps 234 each have an equal portion of the circumference of the formed apertures 222, such that the lower receiver is half and the upper cap is half. The dividing tool 232 forms the dividing channel 236 that substantially divides the pair of accessory rings 218 into lower receivers and upper caps 234 through engagement with the accessory rings along an axis that is parallel with the axis X.

Figure 11:
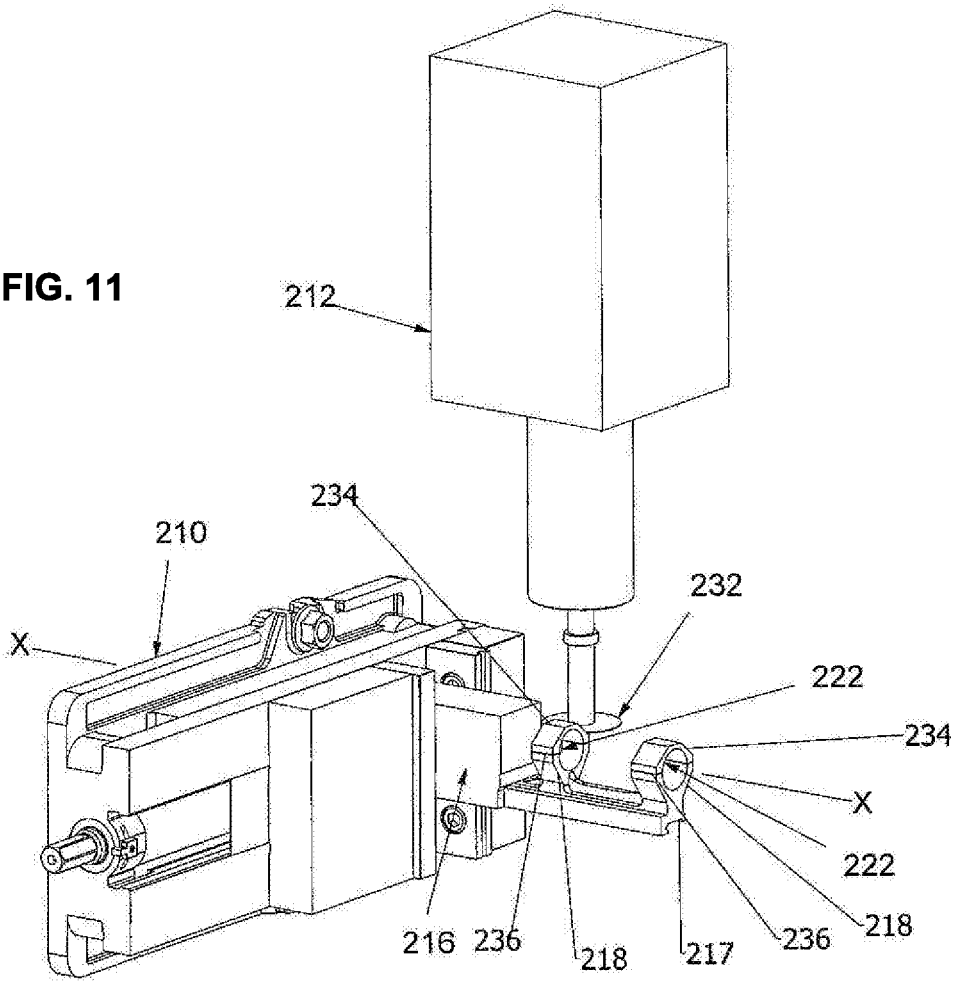
FIG. 11 shows a left side perspective view of the bored and partially machined raw extrusion of material shown in FIG. 9 having been cut with the cutting tool.

FIG. 11 illustrates an example of the dividing operation 156 described in FIG. 3 and illustrated in FIG. 10, as viewed along a different orientation. FIG. 10 illustrates the securing device 210, the machine 212, the unshaped portion of the raw extrusion of material 216, the mounting base 217, the accessory rings 218 and formed apertures 222 defining internal passageways, a dividing tool 232, an upper cap 234 and a dividing channel 236. As illustrated, FIG. 11 shows the securing device 210, the machine 212, the unshaped portion of the raw extrusion of material 216, the accessory rings 218, the apertures 222, the mounting base 217, the dividing tool 232, the upper caps 234 and the dividing channel 236.

The unshaped portion of the raw extrusion of material 216, accessory rings 218 and mounting base 217 (FIGS. 4-11) can thereafter be removed from securing device 210.

Figure 12:
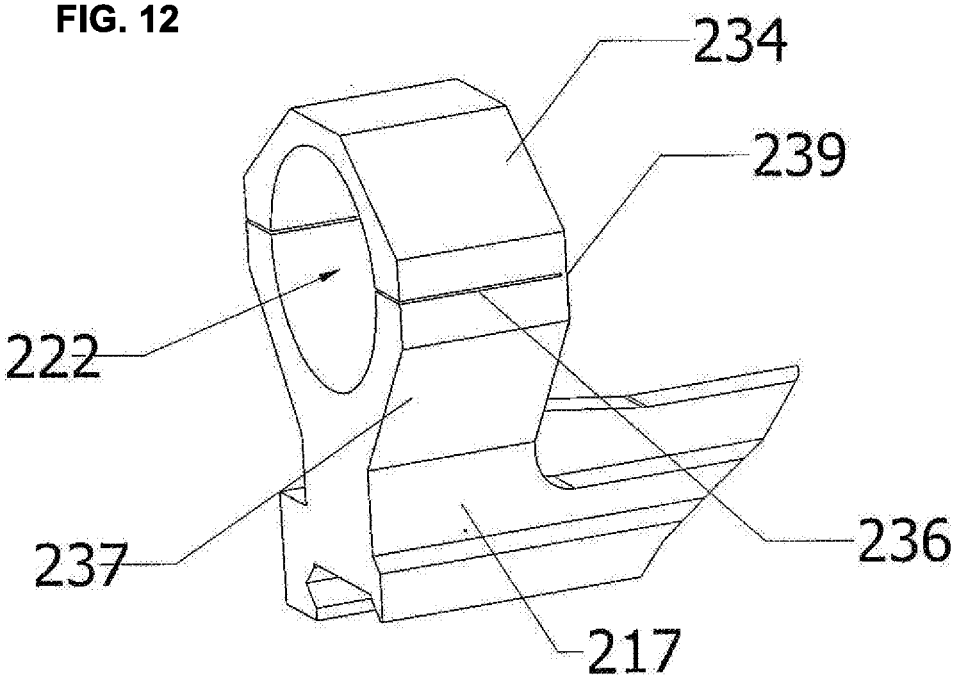
FIG. 12 is an enlarged perspective view of one of the bored and cut scope rings shown in FIG. 11.

FIG. 12 illustrates one of the pair of accessory rings 218 on the mounting base 217, as illustrated in FIGS. 10 and 11. The following description is also applied to the other accessory ring 218 in the pair illustrated in FIGS. 10 and 11. The illustrated accessory ring 218 shows the aperture 222 defining the internal passageway between an upper cap 234 and a lower receiver 237. The dividing channel 236 substantially divides the lower receiver 237 and the upper cap 234, leaving a sliver 239 of material undivided (or uncut) between the lower receivers and the upper caps. As illustrated, the sliver 239 of undivided material remains connecting the lower receiver 237 and the upper cap 234. In some embodiments the sliver 239 has a thickness and a height in a range from about 0.003 inch to about 0.005 inch. As contemplated, the upper cap 234 and the lower receiver 237 remain attached to each other by this sliver of material 239 until a user is ready to install an accessory, for example a scope or laser sight, onto a firearm.

Figure 13:
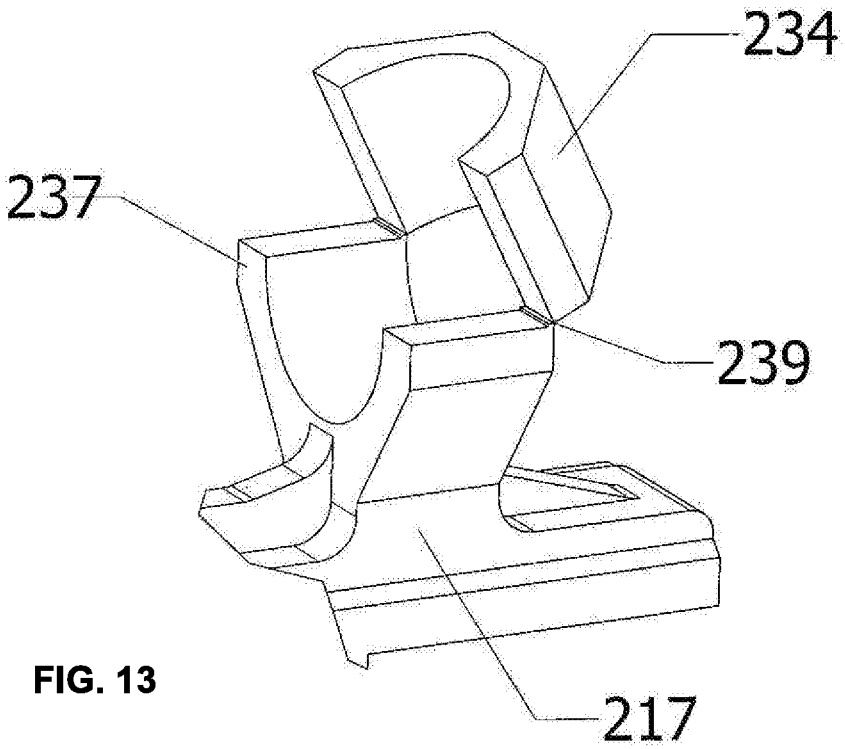
FIG. 13 is an enlarged perspective view of the bored and cut scope ring shown in FIG. 12, showing the cap folded upwards away from the base.

FIG. 13 illustrates the accessory ring on the mounting base 217 that is shown in FIG. 12. The following description is also applied to the other accessory ring 218 in the pair illustrated in FIGS. 10 and 11. As illustrated, when the dividing tool 232 described in FIGS. 10 and 11 has completed the dividing process, the upper cap 234 can be bent or folded away from the lower receiver 237. As illustrated, the sliver 239 of material connects the divided upper cap 234 and the lower receiver 237.

Figure 14:
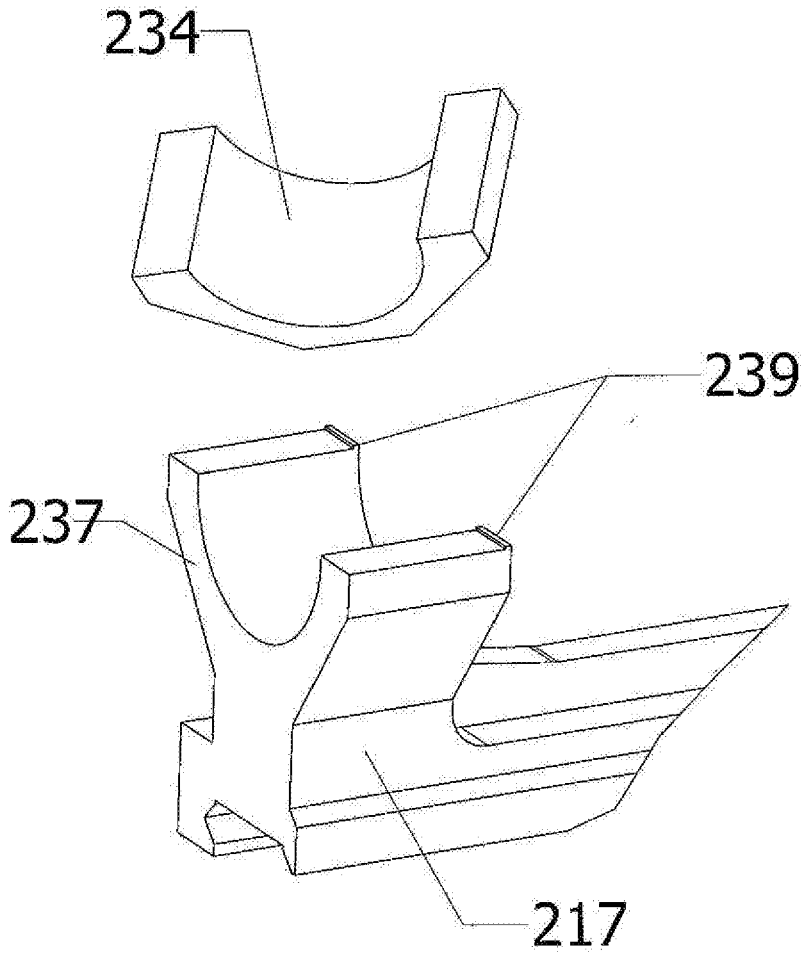
FIG. 14 is an enlarged perspective view of the bored and cut scope ring shown in FIGS. 12-14, showing the cap snapped off of the base.

FIG. 14 illustrates the snapping operation 158 and the buffing operation 160 described in FIG. 3. FIG. 14 illustrates the accessory ring on the mounting base 217 that is shown in FIGS. 12 and 13. The following description is also applied to the other accessory ring 218 in the pair illustrated in FIGS. 10 and 11. As illustrated, the upper cap 234 can be snapped off of the lower receiver 237, which remains secured to the mounting base 217. The upper cap 234 can be snapped off of the lower receiver 237 manually with a user's hands, for example through a toggling or pivoting motion, or with a blunt object such as a piece of wood, because the sliver 239 of the remaining undivided material is minimal and in at least some embodiments does not require tools to be broken.

When the upper cap 234 is snapped off of the lower receiver 237, residue from the undivided sliver 239 of material remains on the upper cap and/or the lower receiver. This remaining residue of undivided material 239 can then be buffed out by a buffing tool, for example a buffing tool that would be familiar to a person of ordinary skill in the art, to render the surface smooth and free of residue, for example as illustrated on the surface of the upper cap 234. In use, as illustrated in the examples described in FIGS. 1 and 2, the upper cap 234 and lower receiver 237 can be secured on opposing sides of a firearm accessory, for example a scope or laser sight, and the mounting base 217 can be secured to a firearm.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or operations. Thus, such conditional language is not generally intended to imply that features, elements, and/or operations are in any way required for one or more embodiments.

What is claimed is:

1. A firearm accessory intermediary assembly, comprising:

a mounting base comprising a first end and a second end;

a first accessory ring extending from the first end of the mounting base, the first accessory ring comprising a first receiver and a first cap forming a first internal passageway oriented about a longitudinal axis of the mounting base, the first receiver and the first cap being coupled together by a first and a second sliver of manually breakable material; and a second accessory ring extending from the second end of the mounting base, the second accessory ring comprising a second receiver and a second cap forming a second internal passageway oriented about the longitudinal axis, the second receiver and the second cap being coupled together by a third and a fourth sliver of manually breakable material, wherein the first internal passageway is aligned with the second internal passageway, the first and second slivers of manually breakable material are configured to operate as hinges that facilitate rotation of the first cap in relation to the first receiver about a first axis; and the third and fourth slivers of manually breakable material are configured to operate as hinges that facilitate rotation of the second cap in relation to the second receiver about a second axis.

2. The firearm accessory intermediary assembly of claim 1, wherein the first internal passageway and the second internal passageway are ring shaped.

3. The firearm accessory intermediary assembly of claim 1, wherein the first internal passageway is concentrically aligned with the second internal passageway.

4. The firearm accessory intermediary assembly of claim 1, wherein a planar channel divides the first cap and the first receiver, the planar channel extending from an outer surface of the first accessory ring to an inner surface of the first sliver of manually breakable material.

5. The firearm accessory intermediary assembly of claim 1, wherein a planar channel divides the second cap and the second receiver, the planar channel extending from an outer surface of the second accessory ring to an inner surface of the another third sliver of manually breakable material.

6. The firearm accessory intermediary assembly of claim 1, wherein the first receiver and the first cap comprise equal portions of a circumference of the first passageway, and the second receiver and the second cap comprise equal portions of a circumference of the second passageway.

7. The firearm accessory intermediary assembly of claim 1, wherein the first accessory ring comprises a first planar channel between each of two portions of the first receiver and the first cap, and wherein the second accessory ring comprises a second planar channel between each of two portions of the second receiver and the second cap.

8. The firearm accessory intermediary assembly of claim 1, wherein the first cap is configured to manually separate from the first receiver by bending the first cap away from the first receiver.

9. The firearm accessory intermediary assembly of claim 1, wherein the first sliver of manually breakable material that couples the first receiver and the first cap has a thickness of about 0.003 inches to about 0.005 inches.

10. The firearm accessory intermediary assembly of claim 1, wherein the third sliver of manually breakable material that couples the second receiver and the second cap has a thickness of about 0.003 inches to about 0.005 inches.

11. The firearm accessory intermediary assembly of claim 1, wherein the first cap and the second cap are geometrically identical, and the first receiver and the second receiver are geometrically identical.

12. The firearm accessory intermediary assembly of claim 1, wherein the first internal passageway and the second internal passageway are formed with a tool proceeding through a single motion along a single axis.

13. The firearm accessory intermediary assembly of claim 1, wherein each of the first and second slivers of manually breakable material extend transversely in relation to the longitudinal axis of the mounting base.

* * * * *